US009373315B1

(12) United States Patent
Hummel

(10) Patent No.: US 9,373,315 B1
(45) **Date of Patent: *Jun. 21, 2016**

(54) CARTRIDGE RECEIVER FOR A TONE EFFECTS SYSTEM

(71) Applicant: Markus Oliver Hummel, Los Altos Hills, CA (US)

(72) Inventor: Markus Oliver Hummel, Los Altos Hills, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/045,637

(22) Filed: Feb. 17, 2016

Related U.S. Application Data

(63) Continuation-in-part of application No. 14/632,521, filed on Feb. 26, 2015, now Pat. No. 9,293,125, which is a continuation of application No. 14/073,689, filed on Nov. 6, 2013, now Pat. No. 9,012,759.

(60) Provisional application No. 61/724,106, filed on Nov. 8, 2012.

(51) Int. Cl.

| | |
|---|---|
| ***G10H 1/02*** | (2006.01) |
| ***G10H 1/00*** | (2006.01) |
| ***G10H 1/32*** | (2006.01) |
| ***G10H 3/18*** | (2006.01) |
| ***G10H 1/34*** | (2006.01) |

(52) U.S. Cl.
CPC ..... *G10H 1/342* (2013.01); *G10H 3/186* (2013.01)

(58) Field of Classification Search
CPC ..... G10H 1/02; G10H 1/0091; G10H 1/32; G10H 3/186; G10H 1/342
USPC ..... 84/737, 743
See application file for complete search history.

(56) References Cited

U.S. PATENT DOCUMENTS

| | | | | | |
|---|---|---|---|---|---|
| 4,509,190 | A * | 4/1985 | Spector | H04R 3/12 | 381/119 |
| 5,637,823 | A * | 6/1997 | Dodge | G10H 1/32 | 84/726 |
| 5,767,432 | A * | 6/1998 | Randolph | G10D 1/085 | 84/267 |
| 6,075,194 | A * | 6/2000 | Marinic | G10H 1/10 | 84/600 |
| 6,376,761 | B1 * | 4/2002 | LaMarra | G10H 1/02 | 381/118 |
| 7,326,849 | B2 * | 2/2008 | Adams | G10H 1/0066 | 84/743 |
| 7,711,442 | B2 * | 5/2010 | Ryle | G10H 3/186 | 700/94 |
| 7,786,371 | B1 * | 8/2010 | Moates | G10H 1/0066 | 84/464 R |
| 7,838,758 | B2 * | 11/2010 | Van Ekstrom | G10H 3/183 | 84/726 |
| 8,075,342 | B1 * | 12/2011 | Harney | G10H 3/186 | 439/620.01 |
| 9,012,759 | B2 * | 4/2015 | Hummel | G10H 1/342 | 84/737 |
| 2014/0123837 | A1 * | 5/2014 | Hummel | G10H 1/342 | 84/622 |
| 2015/0170627 | A1 * | 6/2015 | Hummel | G10H 1/08 | 84/659 |
| 2015/0179158 | A1 * | 6/2015 | Hummel | G10H 3/00 | 84/626 |

* cited by examiner

*Primary Examiner* — Jeffrey Donels

(57) ABSTRACT

A cartridge receiver for a tone effects system used with an electric instrument that allows for reduced or eliminated signal loss before sound effects are applied. The cartridge receiver is integrated into the body of a desired electric instrument, while an effects cartridge is attached to the electric instrument via the cartridge receiver; the cartridge receiver providing electronic connections between the electric instrument and the effects cartridge. The effects cartridge provides an effects circuit for manipulating the received electronic signal, as well as an at least one effects control for adjusting the extent to which the effect is applied to the electronic signal. The cartridge receiver can be internally mounted within the electric instrument, wherein the cartridge receiver is fully recessed, or the cartridge receiver can be externally mounted to the electric instrument.

8 Claims, 7 Drawing Sheets

CARTRIDGE RECEIVER FOR A TONE EFFECTS SYSTEM

The current application is a continuation in part of U.S. patent application Ser. No. 14/632,521 filed on Feb. 26, 2015 which is a continuation of U.S. patent application Ser. No. 14/073,689 filed on Nov. 6, 2013 which claims benefit of U.S. Provisional Patent Application 61/724,106 filed on Nov. 8, 2012.

FIELD OF THE INVENTION

The present invention relates generally to electronic instrument effects. More specifically, the present invention is an apparatus for various sound effects or appliances that are integrated directly into the body of an electric musical instrument for easy access, manipulation of controls and interchangeability.

BACKGROUND OF THE INVENTION

In the music industry, it has often been desirable to alter the sound produced from a musical instrument using sound effects. Sound effects were originally produced using techniques such as manipulating reel-to-reel tape after recording or through microphone placement during recording. As such, early sound effects were limited to in studio productions. The ability for individual musicians to manipulate instrument sounds in-home became available with the emergence of sound effects modules. Sound effects modules are electronic devices that allow musicians to manipulate the sound produced from an electric or electronic instrument. Earlier standalone sound effects modules were impractical as the equipment was both bulky and costly. Thus, the first practical sound effects modules to be used regularly outside of the studio were those built into amplifiers using vacuum tubes. With the emergence of the electronic transistor, sound effects circuitry was able to be even further condensed into small, portable containers commonly referred to as stompbox units. Stompbox units can be designed to produce one or more effects and typically provide a number of controls for adjusting the extent to which the sound of the instrument is manipulated.

While sound effects modules are used with many different types of musical instruments, sound effects modules are most notably used in conjunction with electric guitars in the form of stompboxes. One issue with the use of stompboxes with electric guitars is cable signal loss, which is due, at least in part, to the length of the guitar cable that is used between the guitar and the stompboxes. The cable signal loss across the guitar cable between where the electronic signal of the guitar is generated to where the sound effect is applied results in a loss in tone, which is undesirable to most musicians. Ideally, tone effects are applied as close to the signal generation as possible in order to reduce the amount of signal loss that occurs before the effect is applied. Another issue associated with stompboxes is their accessibility. Stompboxes are typically either placed at the feet of the user or mounted together on a rack. Thus, in order for a musician to adjust the effects controls they must do so with their feet or be within an arm's reach of the rack. Resultantly, effects controls are typically adjusted before a set or an individual song and are not altered throughout.

Therefore it is an object of the present invention to provide an apparatus that integrates electronic effects modules directly into the body of an electric instrument for easy access and manipulation of controls, reduction in signal loss before applied effects, and interchangeability of effects modules. A cartridge receiver and a changeover switch are integrated into the body of the instrument, while an effects cartridge is attached to the instrument via the cartridge receiver. Signal loss between signal generation and the applied sound effect is reduced or altogether eliminated as the cartridge receiver is mounted directly onto the electric instrument, thus reducing the length of wire that the generated electronic signal must traverse in order to reach the effects cartridge. The cartridge receiver provides electronic connections between the electric instrument and the effects cartridge, while the changeover switch is used to direct the electronic signal of the electric instrument through the effects cartridge. The effects cartridge provides the circuitry for manipulating the received electronic signal, as well as tone effects controls for adjusting the extent to which the effect is applied to the electronic signal. The present invention gives a musician much more creativity and control by placing tone effects controls within a hand's reach while the instrument is being played.

DETAIL DESCRIPTIONS OF THE INVENTION

All illustrations of the drawings are for the purpose of describing selected versions of the present invention and are not intended to limit the scope of the present invention.

The present invention is a cartridge receiver for a tone effects system for use with electric or electronic instruments that allows for reduced or eliminated signal loss before sound effects are applied to the electronic signal of the instrument. While the tone effects system is intended for use with electric guitars, the tone effects system can be used with any other electric or electronic instrument. In the preferred embodiment of the present invention, the tone effects system is designed to be retrofitted to an existing instrument; however, the tone effects system may be integrated into new instruments at the time of manufacture if so desired.

The tone effects system comprises a cartridge receiver 1, an effects cartridge 2, and a changeover switch 3. The cartridge receiver 1 is attached to an electric instrument 5 and serves as a docking station for the effects cartridge 2. The effects cartridge 2 allows the user to readily manipulate the electronic signal of the electric instrument, while the changeover switch 3 is used to direct the electronic signal of the electric instrument through the effects cartridge 2. Signal loss between where the electronic signal is generated and where the sound effect is applied is significantly reduced as a result of the effects cartridge being closely wired to where the electronic signal is generated within the electric instrument. The effects cartridge 2 is removably attached to the cartridge receiver 1 such that the effects cartridge 2 configured to produce one sound effect can be replaced with the effects cartridge 2 configured to produce a different sound effect.

Figure 4:
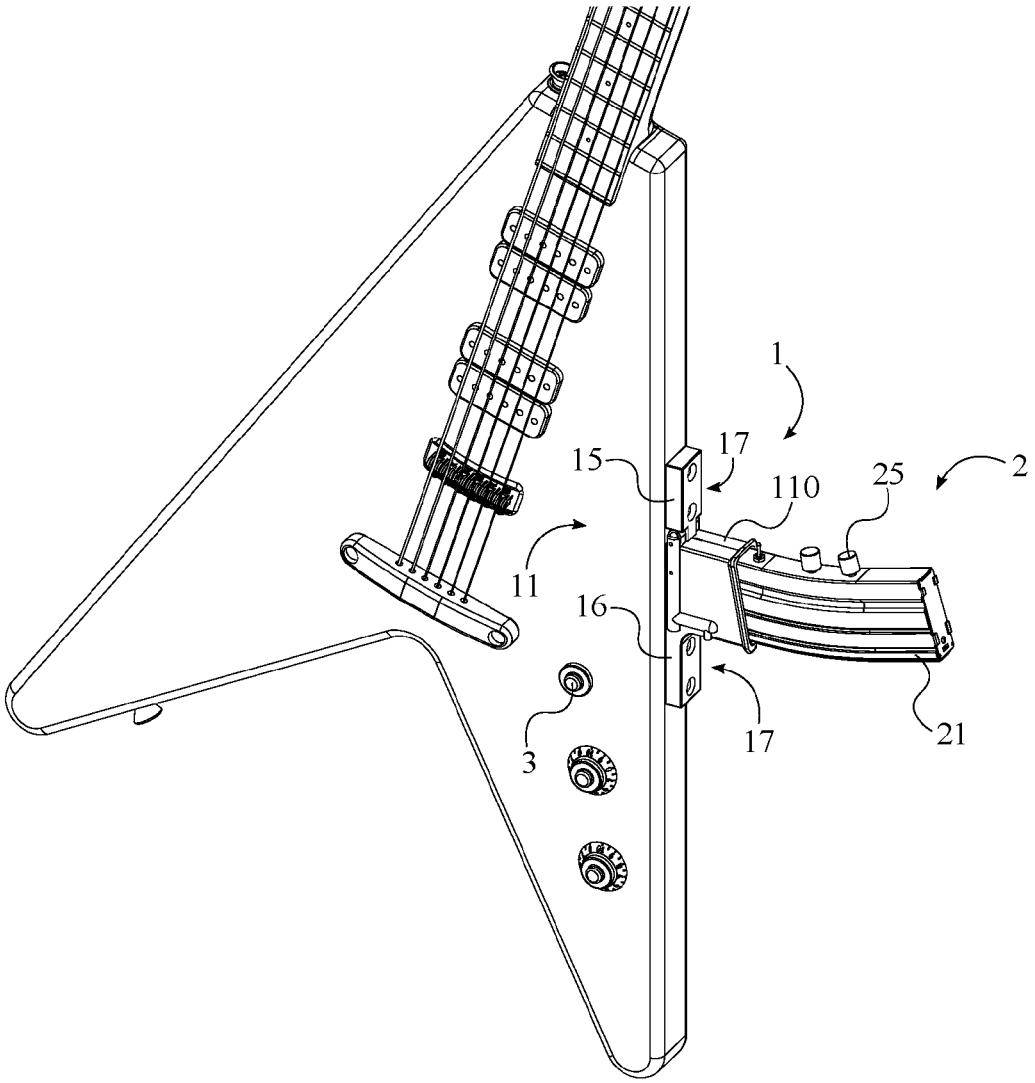
FIG. 4 is a perspective view of the cartridge receiver retrofitted onto the electric instrument being an electric guitar.

In reference to FIG. 4, the cartridge 1 receiver and the changeover switch 3 are connected to the electric instrument 5 such that they are accessible to the user. In the preferred embodiment of the present invention, the cartridge receiver 1 is mounted internally on the electric instrument 5; however, it is also possible for the cartridge receiver 1 to be mounted to the electric instrument 5 externally. Ideally, the changeover switch 3 is used as a replacement to an existing control of the electric instrument 5. For example, if the tone effects system is used in conjunction with an electric guitar, then a tone control of the electric guitar can be removed and replaced with the changeover switch 3, thus minimizing any alterations to the instrument (i.e. drilling additional holes into the instrument body). Of course, it is also possible for the changeover switch 3 to be mounted to any other accessible region of the instrument.

Figure 1:
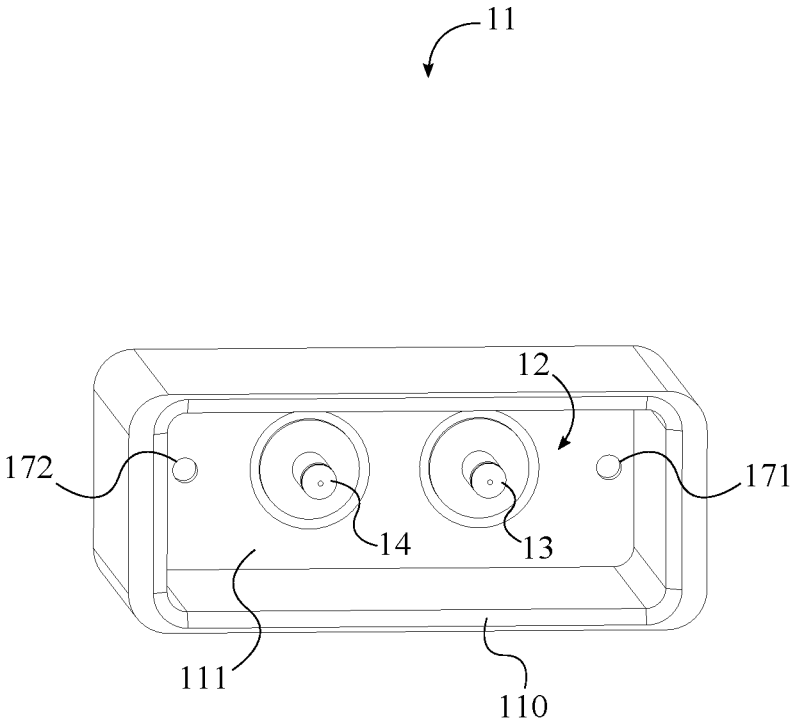
FIG. 1 is a perspective view of the cartridge receiver in the preferred embodiment, wherein the cartridge receiver is configured to be positioned within the electric instrument.

In reference to FIG. 1, the cartridge receiver 1 comprises a receiver body 11, a receiving volume 12, a signal-in terminal 13, a signal-out terminal 14, and a plurality of holes 17. The receiver body 11 is the central structure of the cartridge receiver 1 and defines the general shape of the cartridge receiver 1. The receiving volume 12 is positioned into the receiver body 11 and is the empty space into which the effects cartridge 2 is positioned when the effects cartridge 2 is attached to the cartridge receiver 1. Both the signal-in terminal 13 and the signal-out terminal 14 are connected to the receiver body 11 and positioned adjacent to each other within the receiving volume 12. The cartridge receiver 1 is electronically connected to the effects cartridge 2 through the signal-in terminal 13 and the signal-out terminal 14.

More specifically, the receiver body 11 comprises a lateral wall 110 and an end plate 111, wherein the lateral wall 110 is perimetrically connected to the end plate 111. Together, the lateral wall 110 and the end plate 111 delineate the receiving volume 12 into which the effects cartridge 2 is positioned. The signal-in terminal 13 and the signal-out terminal 14 are adjacently connected to the end plate 111, wherein the signal-in terminal 13 and the signal-out terminal 14 extend along the receiving volume 12, away from the end plate 111. Meanwhile, the plurality of holes 17 traverses through the receiver body 11, providing a means of connection between the electric instrument 5 and the cartridge receiver 1.

Figure 2:
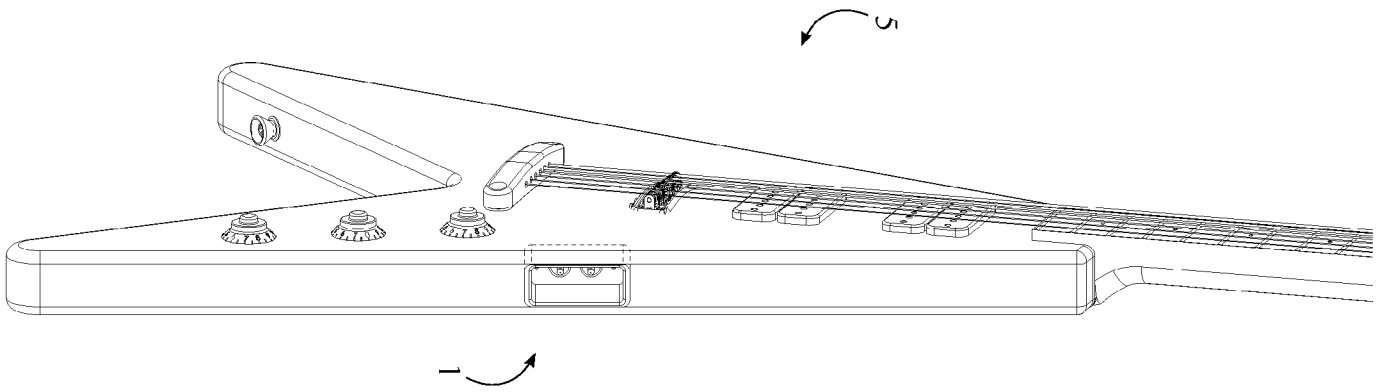
FIG. 2 is a perspective view of the cartridge receiver recessed in the electric instrument being an electric guitar.

In reference to FIG. 2, in the preferred embodiment of the present invention, the receiver body 11 is recessed in the electric instrument 5, such that the profile of the electric instrument 5 is unchanged. A recess matching the profile of the receiver body 11 is hollowed out of the electric instrument 5, such that the receiver body 11 fits snuggly within the electric instrument 5. In order to keep the profile of the receiver body 11 streamlined, the plurality of holes 17 traverses through the end plate 111; more specifically, the plurality of holes 17 comprises a first hole 171 and a second hole 172, wherein the first hole 171 and the second hole 172 traverse through the end plate 110, as shown in FIG. 1. Once the receiver body 11 is positioned within the electric instrument 5, a screw is positioned through the first hole 171 and the second hole 172 to secure the receiver body 11 to the electric instrument 5. The first hole 171 and the second hole 172 are positioned opposite each other along the end plate 111, wherein the signal-in terminal 13 and the signal-out terminal are positioned in between the first hole 171 and the second hole 172. Such a configuration allows both sides of the receiver body 11 to be securely anchored within the electric instrument 5.

Figure 3:
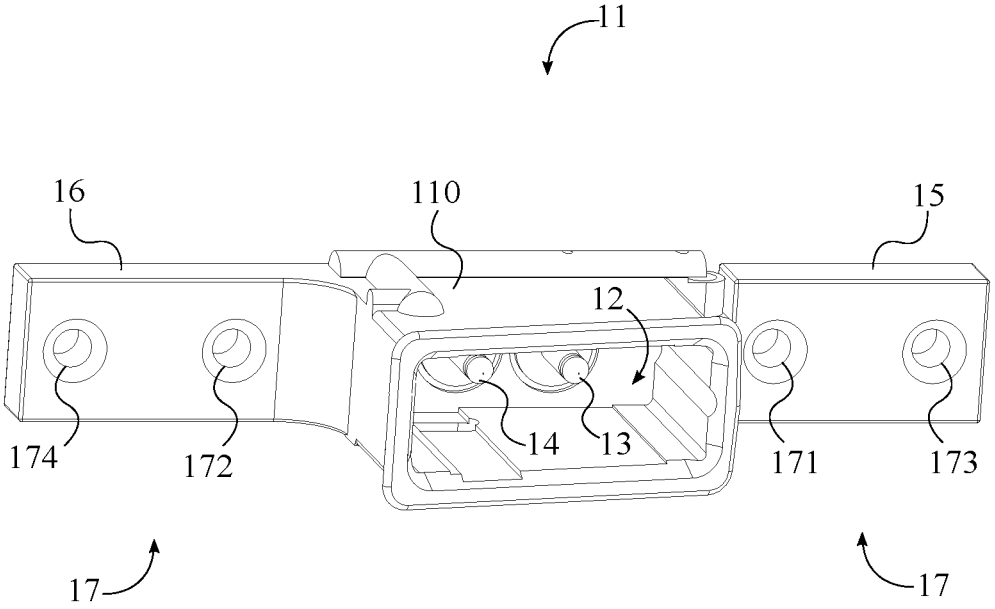
FIG. 3 is a perspective view of the cartridge receiver in the external embodiment, wherein the receiver body includes the first flange and the second flange.

In reference to FIG. 3-4, in an external embodiment, the receiver body 11 is mounted to the electric instrument 5 externally and comprises a first flange 15 and a second flange 16. The first flange 15 and the second flange 16 are adjacently connected to the lateral wall 110 opposite the receiving volume 12, wherein the first flange 15 and the second flange 16 are positioned opposite each other across the lateral wall 110. The first flange 15 and the second flange 16 provide stability to the receiver body, allowing the cartridge receiver 1 to be securely mounted to the exterior of the electric instrument 5, wherein the plurality of holes 17 traverses through both the first flange 15 and the second flange 16.

In reference to FIG. 3, in the external embodiment, the plurality of holes 17 further comprises a third hole 173 and a fourth hole 174 to further stabilize the connection between the cartridge receiver 1 and the electric instrument 5. The first hole 171 and the third hole 173 traverse through the first flange, while the second hole 172 and the fourth hole 174 traverse through the second flange. The first hole 171 is positioned adjacent to the lateral wall 110, while the third hole 173 is positioned adjacent to the first hole 171 opposite the lateral wall 110. Similarly, the second hole 172 is positioned adjacent to the lateral wall 110, while the fourth hole 174 is positioned adjacent to the second hole 172 opposite the lateral wall 110. The use of two holes through each of the first flange 15 and the second flange 16 ensures that the cartridge receiver 1 is securely anchored to the electric instrument 5.

Screws are inserted through each of the plurality of holes 17 and threaded into screw holes drilled into the electric instrument 5 in order to connect the cartridge receiver 1 to the electric instrument 5. Alternatively, the screws can be threaded directly into the surface of the electric instrument 5. Additional holes are drilled through the electric instrument 5 adjacent to the receiver body 11 in order to allow electrical wire to be connected to the signal-in terminal 13 and the signal-out terminal 14.

Figure 5:
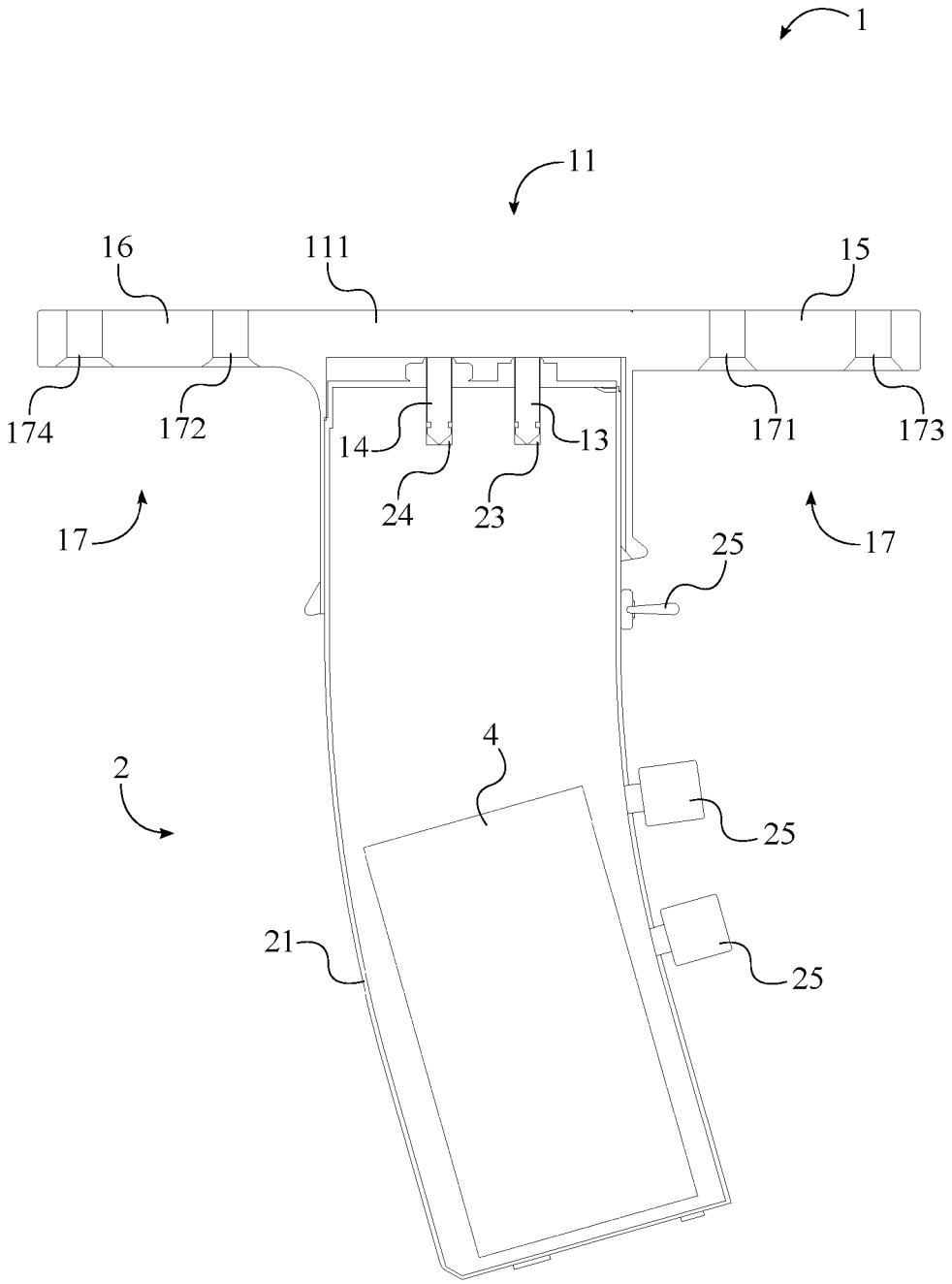
FIG. 5 is a left-side sectional view of the effects cartridge positioned within the cartridge receiver.

In reference to FIG. 5, the first flange 15 and the second flange 16 are positioned on the lateral wall 110 adjacent to the end plate 111. In this way, the first flange 15, the second flange 16, and the end plate 111 rest flush against the surface of the electric instrument 5, while the receiving volume 12 is directed away from the electric instrument 5, such that the effects cartridge 2 can be attached to the cartridge receiver 1. The first flange 15 and the second flange 16 are positioned opposite each other along the end plate 111 in order to securely hold the cartridge receiver 1 flush against the surface of the electric instrument 5.

Figure 6:
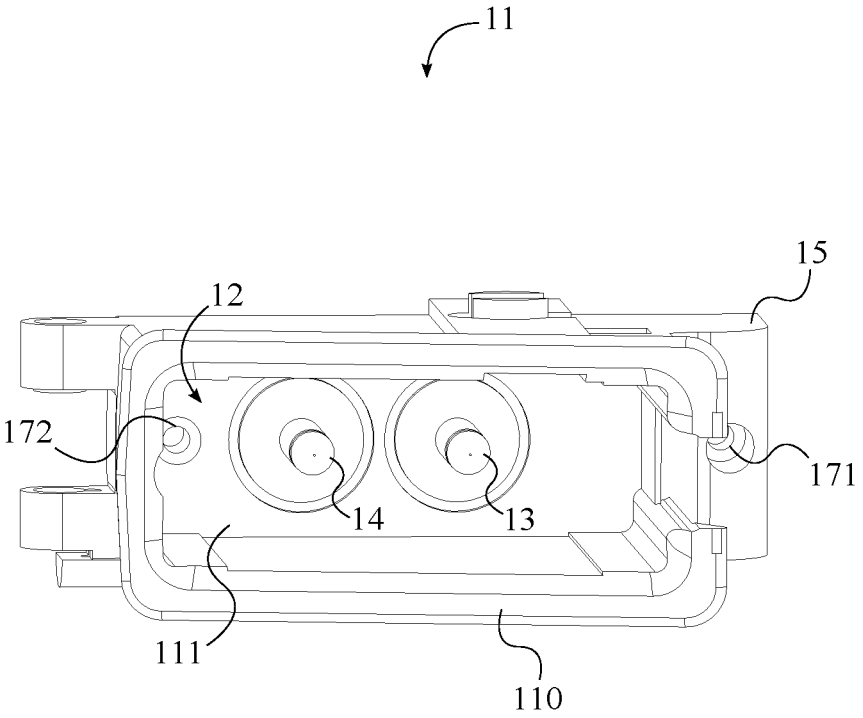
FIG. 6 is a perspective view of the cartridge receiver in the compact external embodiment, wherein the receiver body includes only the first flange.

In reference to FIG. 6, in a compact external embodiment, the receiver body 11 comprises only the first flange 15, while the plurality of holes 17 comprises only the first hole 171 and the second hole 172. The first flange 15 is adjacently connected to the lateral wall 110 opposite the receiving volume 12, wherein the first hole 171 traverses through the first flange 15. Meanwhile, the second hole 172 traverses through the end plate 111 opposite the first flange 15, such that the signal-in terminal 13 and the signal-out terminal 14 are positioned in between the first hole 171 and the second hole 172. The first flange 15 provides increased stability, while the absence of the second flange 16 reduces the profile of the receiver body 11 as the cartridge receiver 1 is mounted externally on the electric instrument 5.

In reference to FIG. 5, the effects cartridge 2 is the component of the tone effects system that allows the electronic signals of the electric instrument 5 to be manipulated in order to produce the desired sounds from the electric instrument 5. The effects cartridge 2 comprises a cartridge casing 21, a signal-in port 23, a signal-out port 24, an effects circuit 4, and an at least one effects control 25. The cartridge casing 21 is a generally thin-walled structure that provides a housing for the effects circuit 4, as well as a mounting frame for the signal-in port 23, the signal-out port 24, and the at least one effects button. The effects circuit 4 is positioned within the cartridge casing 21 and provides the various electrical components and wiring required to manipulate the electronic signal of the electric instrument 5 in the desired manner. The signal-in port 23 and the signal-out port 24 are positioned adjacent to each other through the top side of the cartridge casing 21 and are both connected to the cartridge casing 21. The effects cartridge 2 is electronically connected to the cartridge receiver 1 through the signal-in port 23 and the signal-out port 24. Additionally, the signal-in port 23 and the signal-out port 24 are electronically connected to the effects circuit 4.

In reference to FIG. 3, the changeover switch 3 is ideally integrated into the body of the electronic instrument as the replacement for a pre-existing instrument control, such as the tone knob of an electric guitar. The changeover switch 3 allows the user to direct the electronic signal produced by the electric instrument 5 from a normal path through the electric instrument 5 to a manipulated path through the effects cartridge 2. The normal path follows the circuit of the electric instrument 5, while the manipulated path follows the effects circuit 4 of the effects cartridge 2 in order to manipulate the electronic signal of the electric instrument 5 to produce the desired sound. As such, the changeover switch 3 is electronically connected to the signal-in terminal 13 in order to operatively couple the changeover switch 3 to the effects circuit 4.

The changeover switch 3 is a push-on/push-off style switch, wherein the changeover switch 3 is used to direct the electronic signal between the normal path and the manipulated path. When the changeover switch 3 is in the off position, the electronic signal is directed along the normal path through the circuit of the electric instrument 5 and is not manipulated. When the changeover switch 3 is in the on position, the electronic signal is directed along the manipulated path through the effects circuit 4 and manipulated in accordance with the configuration of the effects circuit 4.

In reference to FIG. 5, when the effects cartridge 2 is attached to the cartridge receiver 1, the top end of the cartridge casing 21 is positioned into the receiving volume 12 of the cartridge receiver 1. As the cartridge casing 21 is inserted into the receiving volume 12, the signal-in terminal 13 engages the signal-in port 23, such that the signal-in terminal 13 is positioned into the signal-in port 23. Similarly, the signal-out terminal 14 engages the signal-out port 24, such that the signal-out terminal 14 is positioned into the signal-out port 24. In reference to FIG. 7, when the signal-in terminal 13 is positioned into the signal-in port 23, the signal-in terminal 13 is electronically connected to the signal-in port 23, thus allowing the electronic signal of the electric instrument 5 to be passed through the effects circuit 4 when the changeover switch 3 is in the on position. Likewise, when the signal-out terminal 14 is positioned into the signal-out port 24, the signal-out terminal 14 is electronically connected to the signal-out port 24, thus allowing the manipulated electronic signal to re-enter the circuit of the electric instrument 5 forming the normal path.

Figure 7:
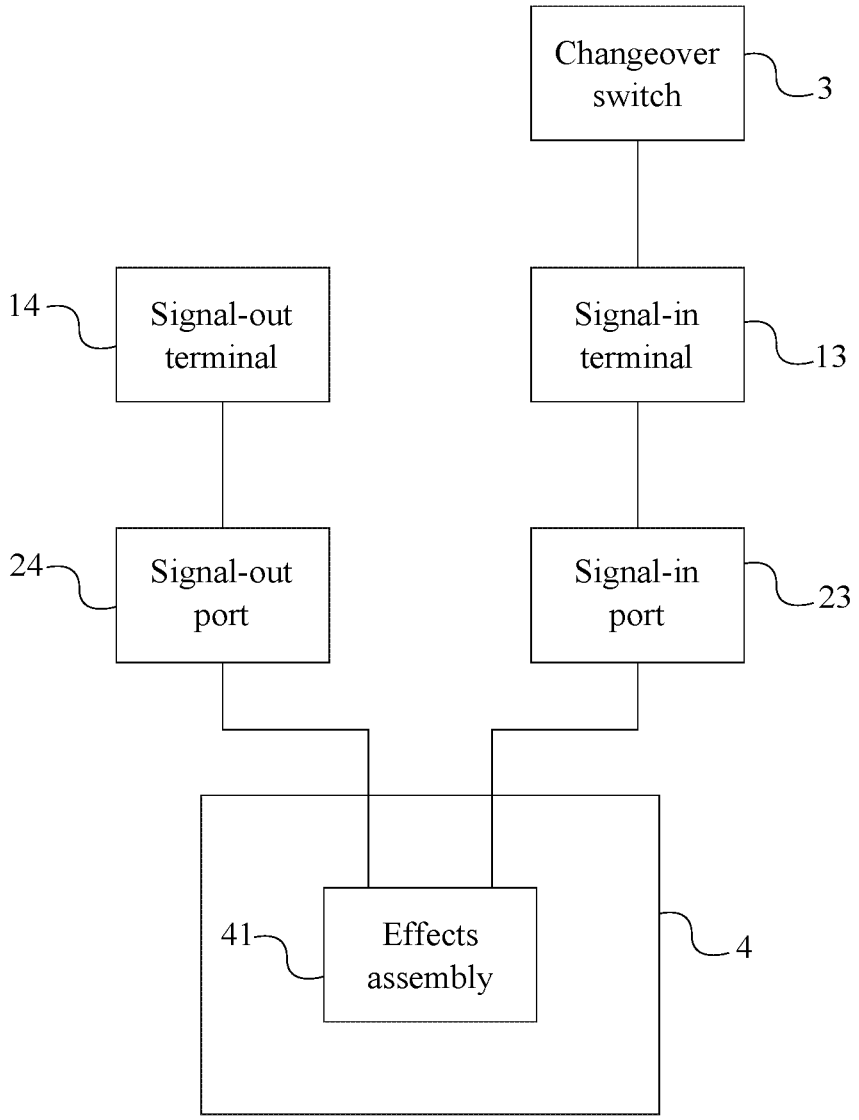
FIG. 7 is a diagram depicting the electrical connections of the effects circuit, effects cartridge, cartridge receiver, and changeover switch.

The effects circuit 4 comprises an effects assembly 41 and a power source 42. The effects assembly 41 provides electronic components for manipulating the electronic signals received from the electric instrument 5 before the electronic signals are returned along the normal path. As such, the effects assembly 41 is electronically connected to the signal-in port 23 and the signal-out port 24, as shown in FIG. 7. The effects circuit 4 may include any electronic components commonly used in the art of tone effects, such as resistors, capacitors, transistors, etc. The electronic components may be arranged in any number of ways in order to produce the desired tone effect. For example, the effects assembly 41 may be configured to produce the tone effect associated with any traditional effects pedals, such as a compressor, booster, wah-wah, overdrive, fuzz, distortion, phaser, flanger, chorus, reverb, delay, or amp modeler pedal. The effects assembly 41 may be configured to produce one tone effect or multiple tone effects.

The effects assembly 41 is electrically connected to the power source 42, such that the power source 42 supplies current to the electronic components of the effects assembly 41. The power source 42 is ideally a battery, either rechargeable or non-rechargeable, and can use any known type of battery technology, such as lithium-ion technology, nickel-cadmium technology, etc. If the power source 42 is a rechargeable battery, then a charging port may also be integrated into the cartridge casing 21, such that the power source 42 does not need to be removed for recharging. If the power source 42 is a non-rechargeable battery, then an access panel may be integrated into the cartridge casing 21 in order to allow the power source 42 to be removed and replaced. If the power source 42 is not a battery, then the cartridge casing 21 may provide a charging port for attaching a power cord between the power source 42 and a power supply such as an outlet.

Characteristics of the effects circuit 4 are adjusted through the at least one effects control 25. As such, the at least one effects control 25 is electronically connected to the effects circuit 4. The at least one effects control 25 is positioned externally on the cartridge casing 21 and is connected to the cartridge casing 21, such that the at least one effects button is readily accessible to the user. The at least one effects control 25 can be used to adjust the extent to which the electronic signal of the electric instrument 5 is manipulated. For example, if the effects assembly 41 is configured to cause distortion in the electronic signal, then the at least one effects control 25 could be a knob used to adjust the level of distortion. Alternatively, the at least one effects control 25 can be a power switch used to control the current supplied by the power source 42.

In one embodiment, the effects circuit 4 comprises a signal converter 43 and a transmitter 45. The signal converter 43 alters the electronic signal of the electric instrument 5 from an analog signal to a digital signal, such that the transmitter 45 is able to transmit the converted electronic signal to an electronic device synchronized with the effects circuit 4. As such, the signal converter 43 is electronically connected to both the signal-in port 23 and the transmitter 45. The transmitted electronic signal can then be manipulated by the synchronized electronic device. As the electronic signal of the electric instrument 5 is transmitted to the electronic device, the electronic signal does not need to re-enter the normal path of the electric instrument 5. Therefore, the effects cartridge 2 does not need to comprise the signal-out port 24. The power source 42 is electrically connected to the signal converter 43 and the transmitter 45, and thus supplies current to both the signal converter 43 and the transmitter 45.

In another embodiment, the effects circuit 4 comprises a speaker 46. The speaker 46 allows the tone effects assembly to produce sound directly from the effects cartridge 2. As such, the speaker 46 is positioned through the cartridge casing 21 and is electronically connected to the signal-in port 23. The incoming electronic signal is directed through a driver of the speaker 46 in order to amplify the electronic signal such that the electronic signal can be used to drive the speaker 46. As the electronic signal of the electric instrument 5 is directed through the built in speaker 46, the electronic signal does not need to re-enter the normal path of the electric instrument 5. Therefore, the effects cartridge 2 does not need to comprise the signal-out port 24. The power source 42 is electrically connected to the speaker 46, and thus supplies current to the speaker 46.

In yet another embodiment, the effects circuit 4 comprises the signal converter 43 and a device terminal 44. Additionally, the effects cartridge 2 further comprises a device dock 26. The device dock 26 is a cavity positioned into the cartridge casing 21 that allows an electronic device, such as a mobile phone, to be attached to the effects cartridge 2. The device terminal 44 is connected to the cartridge casing 21 and is positioned into the device dock 26. The device terminal 44 provides a data connection, as well as an electrical connection, between the effects cartridge 2 and the electronic device. As such, the device terminal 44 is electronically connected to the signal converter 43, which is in turn electronically connected to the signal-in port 23. When the electronic device is positioned within the device dock 26 and attached to the device terminal 44, the incoming electronic signal is directed through the signal converter 43, such that it can then be directed to the electronic device through the device terminal 44. As the electronic signal of the electric instrument 5 is transmitted to the electronic device, the electronic signal does not need to re-enter the normal path of the electric instrument 5. Therefore, the effects cartridge 2 does not need to comprise the signal-out port 24. Additionally, as the device terminal 44 is electrically connected to the signal converter 43, current can be supplied to the signal converter 43 from the electronic device, such that the power source 42 is not needed. The electronic device can be used to apply sound effects to the electronic signal, transmit the electronic signal to another device, record the electronic signal, etc.

Any of the above described embodiments of the effects circuit 4 may be used partly or fully in conjunction with each other, or as a standalone system.

Although the invention has been explained in relation to its preferred embodiment, it is to be understood that many other possible modifications and variations can be made without departing from the spirit and scope of the invention as hereinafter claimed.

What is claimed is:

1. A cartridge receiver for a tone effects system comprises:
- a receiver body;
- a plurality of holes;
- a signal-in terminal;
- a signal-out terminal;
- the receiver body comprises a lateral wall and an end plate;
- the plurality of holes comprises a first hole and a second hole;
- the lateral wall being perimetrically connected to the end plate;
- the lateral wall and the end plate delineating a receiving volume;
- the signal-in terminal and the signal-out terminal being positioned within the receiving volume;
- the signal-in terminal and the signal-out terminal being positioned adjacent to each other;
- the signal-in terminal and the signal-out terminal being connected to the end plate;
- the signal-in terminal and the signal-out terminal being positioned in between the first hole and the second hole; and
- the first hole and the second hole traversing through the receiver body.

2. The cartridge receiver for a tone effects system as claimed in claim 1 comprises:
- the first hole and the second hole traversing through the end plate.

3. The cartridge receiver for a tone effects system as claimed in claim 2 comprises:
- the receiver body being recessed in an electric instrument.

4. The cartridge receiver for a tone effects system as claimed in claim 1 comprises:
- the receiver body further comprises a first flange;
- the first flange being adjacently connected to the lateral wall opposite the receiving volume; and
- the first hole traversing through the first flange.

5. The cartridge receiver for a tone effects system as claimed in claim 4 comprises:
- the plurality of holes comprises a third hole;
- the third hole traversing through the first flange; and
- the third hole being positioned adjacent to the first hole opposite the lateral wall.

6. The cartridge receiver for a tone effects system as claimed in claim 4 comprises:
- the second hole traversing through the end plate.

7. The cartridge receiver for a tone effects system as claimed in claim 4 comprises:
- the receiver body further comprises a second flange;
- the second flange being adjacently connected to the lateral wall opposite the receiving volume; and
- the second hole traversing through the second flange.

8. The cartridge receiver for a tone effects system as claimed in claim 7 comprises:
- the plurality of holes comprises a fourth hole;
- the fourth hole traversing through the second flange; and
- the fourth hole being positioned adjacent to the second hole opposite the lateral wall.

* * * * *